US008905778B2

(12) United States Patent
Jenrich et al.

(10) Patent No.: US 8,905,778 B2
(45) **Date of Patent: *Dec. 9, 2014**

(54) CONTACTING ASSEMBLY FOR CONDUCTORS PRESENT ON FLAT STRUCTURES, IN PARTICULAR GLASS PANELS

(75) Inventors: André Jenrich, Leipzig (DE); Roy Gleisberg, Markranstädt (DE)

(73) Assignee: Few Fahrzeugelektrikwerk GmbH & Co. KG, Zwenkau (DE)

( * ) Notice: Subject to any disclaimer, the term of this patent is extended or adjusted under 35 U.S.C. 154(b) by 51 days.

This patent is subject to a terminal disclaimer.

(21) Appl. No.: 13/695,187

(22) PCT Filed: Mar. 15, 2011

(86) PCT No.: PCT/EP2011/053883

§ 371 (c)(1),
(2), (4) Date: Oct. 29, 2012

(87) PCT Pub. No.: WO2011/134714

PCT Pub. Date: Nov. 3, 2011

(65) Prior Publication Data

US 2013/0045647 A1 Feb. 21, 2013

(30) Foreign Application Priority Data

Apr. 30, 2010 (DE) ..... 10 2010 018 860

(51) Int. Cl.

*H01R 13/62* (2006.01)
*H05B 3/86* (2006.01)
*H01R 4/04* (2006.01)

(52) U.S. Cl.

CPC .. *H05B 3/86* (2013.01); *H01R 4/04* (2013.01); *H05B 2203/016* (2013.01); *Y10S 439/919* (2013.01)

USPC ..... 439/371; 439/919

(58) Field of Classification Search

CPC ..... H01R 4/04; H01R 4/01; H01R 13/187; H05B 3/86

USPC ..... 439/371, 916, 919, 936

See application file for complete search history.

(56) References Cited

U.S. PATENT DOCUMENTS 3,627,981 A * 12/1971 Kuhn ..... 219/212
3,794,953 A 2/1974 Malin (Continued)

FOREIGN PATENT DOCUMENTS

| | | |
|---|---|---|
| DE | 3433437 | 3/1986 |
| FR | 2 893 189 | 5/2007 |
| WO | WO 2004/012302 | 2/2004 |

*Primary Examiner* — James Harvey

(74) *Attorney, Agent, or Firm* — Hamre, Schumann, Mueller & Larson, P.C.

(57) ABSTRACT

The present invention relates to a contacting assembly for conductors that are present on flat structures, in particular glass panels, and have a contact point in the connection section. According to the invention, an end of a connecting cable or of another connecting means, for example, a connecting plug, is connected electrically and mechanically to a pad made of a conductive nonwoven fabric. The connecting cable thus assembled is introduced into a casting block which is open on one side and which has a frame that is provided with adhesive and encloses the nonwoven fabric. The surface of the conductive nonwoven fabric which is delimited laterally by the frame is matched to the area of the contact point, in order to produce, via an adhesive bond between the frame and the flat structure, a contacting connection created by surface pressing between the contact point and the nonwoven fabric surface, wherein the frame together with the casting body seals the contact point with respect to the surrounding area.

7 Claims, 4 Drawing Sheets

(56) References Cited

U.S. PATENT DOCUMENTS

| | | | | |
|---|---|---|---|---|
| 4,385,588 | A * | 5/1983 | Bennetot | 118/638 |
| 5,265,329 | A * | 11/1993 | Jones et al. | 29/832 |
| 5,842,873 | A * | 12/1998 | Gonzales | 439/63 |
| 6,164,984 | A * | 12/2000 | Schreiner | 439/86 |
| 6,840,780 | B1 * | 1/2005 | Antaya et al. | 439/78 |
| 7,270,548 | B2 * | 9/2007 | Jenrich et al. | 439/34 |
| 2004/0067684 | A1 * | 4/2004 | Mueller et al. | 439/578 |
| 2008/0210679 | A1 * | 9/2008 | Raidt et al. | 219/213 |
| 2010/0212828 | A1 * | 8/2010 | Buck et al. | 156/305 |
| 2013/0037296 | A1 * | 2/2013 | Jenrich | 174/50 |
| 2013/0045647 | A1 * | 2/2013 | Jenrich et al. | 439/884 |
| 2013/0269990 | A1 * | 10/2013 | Jenrich et al. | 174/255 |

* cited by examiner

CONTACTING ASSEMBLY FOR CONDUCTORS PRESENT ON FLAT STRUCTURES, IN PARTICULAR GLASS PANELS

FIELD OF THE INVENTION

The invention relates to a contact arrangement, for conductors present on flat entities, particularly glass panes, which have contact points with their connection segment.

BACKGROUND

The use of soldering processes for the purpose of establishing contact to conductors present on flat entities, particularly glass panes, and for example conductors which are designed as heating conductors for a rear window pane, or as antenna conductors, is known.

However, in the ease of soldering, the glass pane is subjected to thermal stress, and this must be avoided particularly in the case of many of the solder points which must be created. In this case, the point-focused application of very high, amounts of thermal energy is particularly problematic.

In the event of a faulty application, a de-soldering process must be carried out, which can in tarn lead to stress cracking in the glass material.

Moreover, the applied solder contacts are visible from the exterior, such that a subsequent blackening must be carried out in certain applications.

Moreover, standard soldering processes use solders which contain more or less lead, which creates a further problem with respect to environmental considerations.

Proceeding from the above, the problem addressed by the invention is that of providing a more developed contact arrangement for conductors present on flat entities, particularly glass panes, which avoids thermal soldering processes on the one hand, and enables faulty contacts to be switched or enables an exchange in the event of a faulty solder application, on die other hand, and wherein finally it is possible to realize a processing without the technical prerequisites of a laser soldering device.

SUMMARY OF THE INVENTION

The invention relates to a contact arrangement for conductors present on flat entities, particularly glass panes, wherein said conductors have a contact point in their connection segment, for example in the form of a conductive surface printed thereon.

The contact arrangements should serve as an electrical connection of an antenna, or as the current supply for heating conductors, and should possess sufficient ampacity for the same.

According to the invention, one end of a connection cable or a connection ping is electrically and mechanically connected to a pad made of a conductive fleece. The arrangement assembled in this manner is inserted into a east block which is open on one side thereof, and which has a frame which surrounds the fleece and has adhesive or is self-adhering.

In addition, the surface of the conductive fleece which is bounded on the sides thereof by the frame is matched to the surface of the contact point on the flat entity, in order to create a contact connection between the contact point and the fleece surface, created by surface pressure, via an adhesive bond between the frame and the flat entity, wherein the frame closes off the contact point from the surroundings by means of cast bodies.

In one embodiment, the end of the connection cable is connected to a conductive film, and the pad in this case is a conductive fleece which adheres on both sides thereof.

The conductive fleece can consist of multiple layers for the purpose of improving the contact as regards the reduction of Ohmic resistance. In this case, multiple layers laid crosswise can be used.

The conductive fleece has elastic properties, such that upon the application of the cast body with the adhesive frame to the contact point of the flat entity, an accordingly reliable contact results. The thickness of the conductive fleece material is preferably larger than the height of the frame of the cast body, or the conductive fleece extends beyond the frame from a perspective above the surface of the frame.

In one embodiment of the invention, the east block can be dyed in order to visually cover the contact point.

As explained above, the frame in one preferred embodiment has self-adhesive properties, and is covered by a protective material prior to the adhering with the flat entity.

The protective material can cover the entire surface bounded by the frame, meaning it can also cover the surface under which the fleece pad is situated. In this way, the contact arrangement can. be pre-fabricated and stored without contamination of the fleece pad and/or any compromise of the adhesive properties of the frame.

In one preferred embodiment, the cast body has a trough-like shape, wherein a plurality of pin-like extensions, lugs, or similar projections are constructed on the inside of this trough-like shape in the direction facing the fleece pad. These function to provide an internal connection between the connection cable ends and/or the conductive film and the fleece pad. In addition, the pin-like extensions ensure an improvement of the contact formation, with resulting increased current carrying capacity, to the extent that they face in the direction toward the contact point on the flat entity.

The contact arranged according to the invention can be designed as monopolar, or also as multipolar inside a cast body, wherein in the latter case pads of conductive fleece arranged next to each other are each connected to a connection cable or to a group of cables.

In the case of a multipolar variant, of the contact arrangements, a multipolar connection can be realized with a single adhesion process, which carries advantages compared to soldering technology. By means of the exclusively adhesive connection, no thermal stress is placed on the flat entity, particularly a corresponding glass pane.

The cable which forms the outer connection can be connected to a conductive fleece by crimping, wherein the cast block additionally prevents tensile loads on the cable by the actual contact region.

BRIEF DESCRIPTION OF THE DRAWINGS

The invention, is described in greater detail below with reference to one embodiment and the figures.

In the figures.

DETAILED DESCRIPTION OF THE INVENTION

Figure 1:
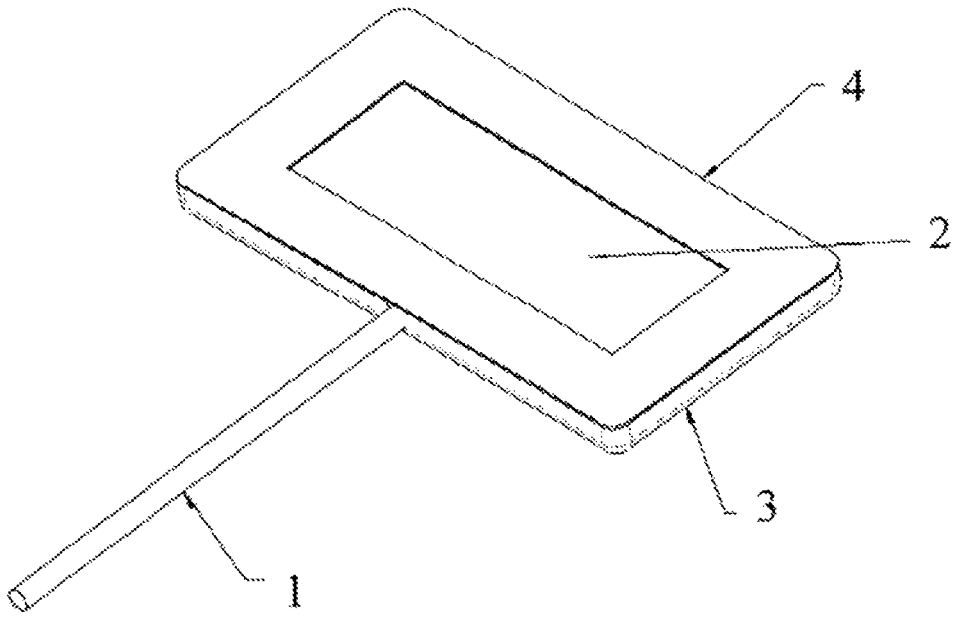
FIG. 1 shows a perspective illustration of the contact arrangements with a view of the underside, having an adhesive frame and a conductive fleece pad surrounded by the same.
Figure 2:
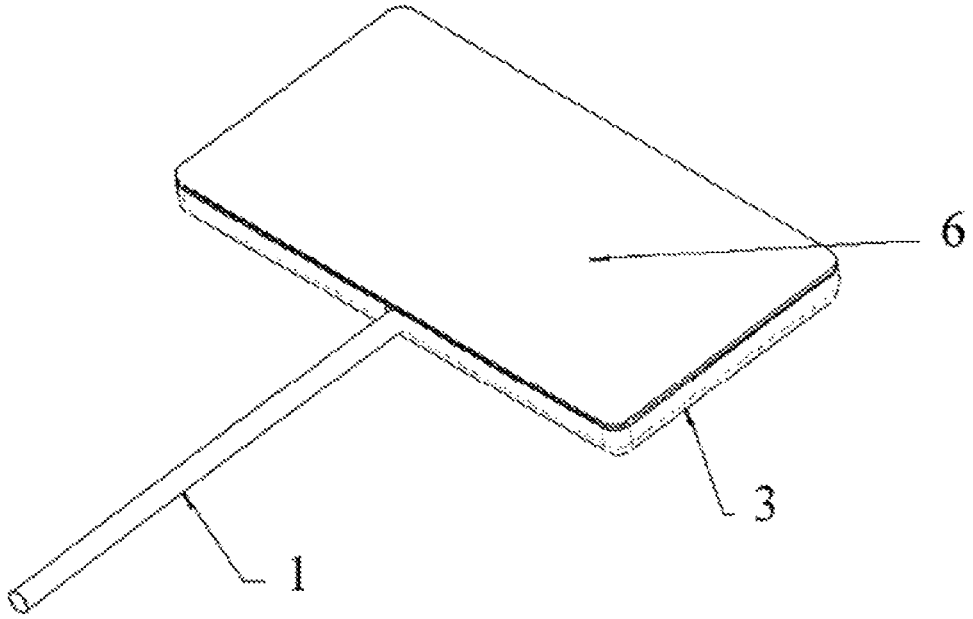
FIG. 2 shows an illustration similar to that in FIG. 1, however with a removable coating which covers the adhesive frame surface.

As can be seen in the illustrations in FIGS. 1 and 2, the contact arrangement according to the invention has a connection cable 1 which can be designed in strands, for example.

This connection cable 1 is connected to an electrically conductive fleece pad 2. This connection can be realized by means of crimping, for example, or can be realized by the interposition of a conductive film which contacts a fleece material which is conductive on both sides.

The cable is inserted into a socketing 3 which comprises a frame 4.

Figure 4:
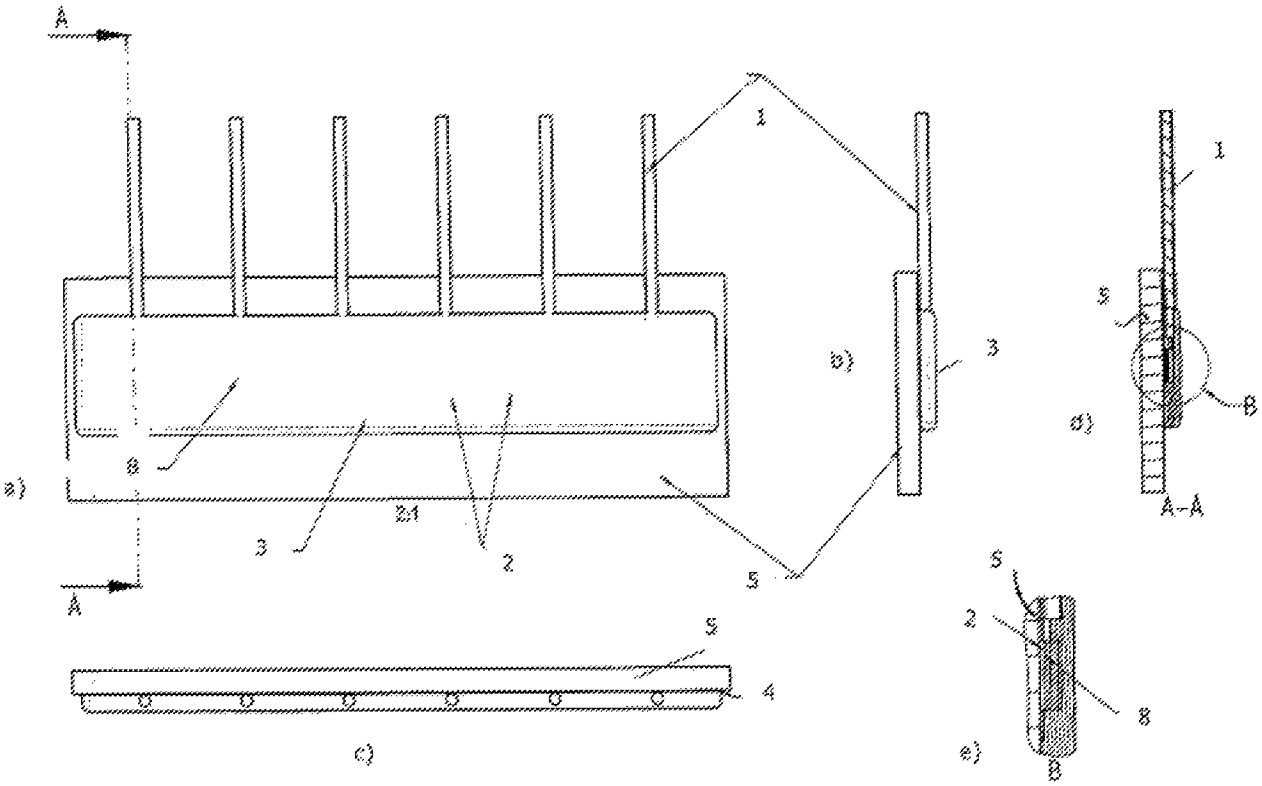
FIG. 4*a* shows a top view of the contact arrangement, located on a glass pane.
FIG. 4*b* shows a side view of the arrangement in FIG. 4*a;*
FIG. 4*c* shows a front view with recognizable cables according to the illustration in FIG. 4*a;*
FIG. 4*d* shows a cutaway illustration along the line A-A in FIG. 4*a* and 4*b*.
FIG. 4*e* shows an enlarged portion of FIG. 4*d* as identified by the letter B.

The frame 4 surrounds the conductive fleece 2 on all sides thereof, but leaves the same open lacing the contact point on the Hat entity 5 (see FIG. 4).

The prefabricated and accordingly assembled contact arrangement according to FIG. 2 is covered by a protective material 6, the same designed as removable paper or a removable liner, and as such is ready tor use.

Figure 3:
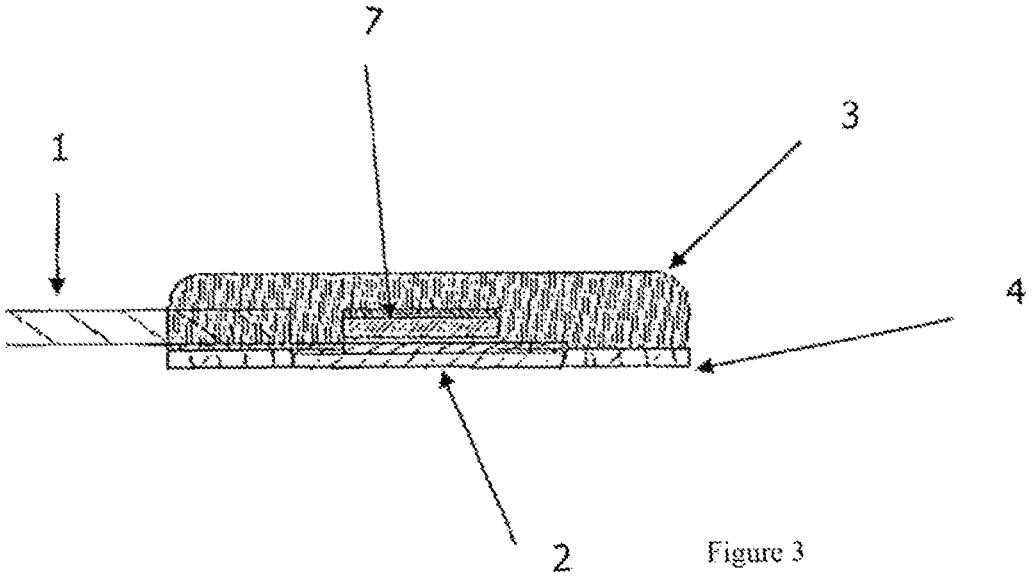
FIG. 3 shows a principle cutaway illustration of the cast body, with an adhesive frame and conductive fleece.

The cutaway view in FIG. 3 renders further details of the construction of the contact arrangement recognizable.

The cable 1 has a cable crimp 7 which extends into the interior of the cast body and is connected at that point to the electrically conductive fleece pad 2. The electrically conductive fleece pad can be designed as a single layer or multiple layers, wherein the same can be arranged crosswise, in order to ensure the required electrical properties.

A previously prepared and assembled contact arrangement can be designed as monopolar, or—as shown in FIG. 4—as multipolar, wherein each cable 1 leads to a corresponding fleece pad 2. The ends of the cable are inserted into cable end sleeves 8, wherein the latter are in contact with the respective fleece pad.

The contact arrangement is fixed in the region corresponding to applied contact points on the glass pane 5 by means of the adhesive frame 4, wherein the individual contact points of the multipolar arrangement are enclosed and sealed.

The cast block 3 can be dyed a dark color, such that the actual contact point remains invisible. A subsequent blackening of conventional solder contacts is hereby unnecessary.

Following from the depiction given above, the cable can be previously soldered directly to fleece which is adhesive on one side, or to a copper film which is connected to the fleece by an adhesive bond.

In this case, the copper film serves to increase the current carrying capacity, more or less as an alternative to fleece variants which consist of multiple layers.

The socketing leads to a desired load reduction, to protection of the contact point, and results in an electrical insulation.

Likewise, it can be seen in the figures that the socketing, designed as a cast block, is open on the underside thereof, in order to electrically connect the conductive fleece to a contact point on the pane, said contact point being applied by screen printing, for example.

The electrical contact between the contact point on the pane and the fleece pad is created mostly or entirely by means of surface pressure. If necessary, the contact arrangements can be removed without destroying the actual contact point situated on the pane, and a new contact can be applied.

In addition, the possibility exists of implementing a cast body with a trough-like shape, in such a manner that, a plurality of pin-like extensions or logs is constructed on the interior facing the fleece pad, for example arranged in the manner of a matrix. Upon, the application of the cast body, constructed in such a manner, to a contact point, the electrical connection is further optimized.

The invention claimed is:

1. A contact arrangement for conductors present on flat entities, particularly glass panes, which have a contact point in their connection segment, wherein one end of a connection cable or other connection means is electrically and mechanically connected to a pad made of a conductive fleece, and the connection cable assembled in this manner is inserted into a cast block which is open on one side, and which has a frame which includes adhesive and which surrounds the fleece, in addition, the surface of the conductive fleece which is bounded on the sides thereof by the frame is adapted to the surface of the contact point in order to create a contact connection between the contact point and the fleece surface, realized by means of surface pressure, via an adhesive connection between the frame and the flat entity, wherein the frame closes off the contact point from the surroundings, wherein the end of the connection cable is connected to a conductive film on which the pad of the conductive fleece is disposed.

2. A contact arrangement for conductors present on flat entities, particularly glass panes, which have a contact point in their connection segment, wherein one end of a connection cable or other connection means is electrically and mechanically connected to a pad made of a conductive fleece, and the connection cable assembled in this manner is inserted into a cast block which is open on one side, and which has a frame which includes adhesive and which surrounds the fleece, in addition, the surface of the conductive fleece which is bounded on the sides thereof by the frame is adapted to the surface of the contact point in order to create a contact connection between the contact point and the fleece surface, realized by means of surface pressure, via an adhesive connection between the frame and the flat entity, wherein the frame closes off the contact point from the surroundings, wherein the layers are arranged in a crosswise manner.

3. A contact arrangement for conductors present on flat entities, particularly glass panes, which have a contact point in their connection segment, wherein one end of a connection cable or other connection means is electrically and mechanically connected to a pad made of a conductive fleece, and the connection cable assembled in this manner is inserted into a cast block which is open on one side, and which has a frame which includes adhesive and which surrounds the fleece, in addition the surface of the conductive fleece which is bounded on the sides thereof by the frame is adapted to the surface of the contact point in order to create a contact connection between contact point and the fleece surface, realized by means of surface pressure, via an adhesive connection between the frame and the flat entity, wherein the frame closes off the contact point from the surroundings, wherein the pad made of conductive fleece has single-sided or double-sided adhesive properties.

4. A contact arrangement for conductors present on flat entities, particularly glass panes, which have a contact point in their connection segment, wherein one end of a connection cable or other connection means is electrically and mechanically connected to a pad made of a conductive fleece, and the connection cable assembled in this manner is inserted into a cast block which is open on one side, and which has a frame which includes adhesive and which surrounds the fleece, in addition, the surface of the conductive fleece which is bounded on the sides thereof by the frame is adapted to the surface of the contact point in order to create a contact connection between the contact point and the fleece surface realized by means of surface pressure, via an adhesive connection between the frame and the flat entity, wherein the frame closes off the contact point from the surroundings, wherein the frame possesses self-adhesive properties and is covered by a protective material prior to the bonding to the flat entity.

5. An arrangement according to claim 4, wherein the protective material covers the entire surface of the cast block bounded by the frame.

6. An arrangement according to claim 1, wherein the conductive fleece possesses elastic properties.

7. An arrangement according to claim 1, wherein the cast block is dyed in order to visually conceal the contact point.

* * * * *